US009347243B2

(12) United States Patent
Talpe

(10) Patent No.: US 9,347,243 B2
(45) Date of Patent: May 24, 2016

(54) ELECTRICAL LOCKING DEVICE WITH FAIL-SAFE EMERGENCY RELEASE

(71) Applicant: Joseph Talpe, Heestert (BE)

(72) Inventor: Joseph Talpe, Heestert (BE)

( * ) Notice: Subject to any disclaimer, the term of this patent is extended or adjusted under 35 U.S.C. 154(b) by 140 days.

(21) Appl. No.: 14/141,920

(22) Filed: Dec. 27, 2013

(65) Prior Publication Data

US 2014/0182343 A1 Jul. 3, 2014

(30) Foreign Application Priority Data

Dec. 27, 2012 (EP) ..... 12199456

(51) Int. Cl.
*E05B 47/00* (2006.01)
*E05B 63/00* (2006.01)
(Continued)

(52) U.S. Cl.
CPC ..... *E05B 47/0001* (2013.01); *E05B 47/026* (2013.01); *E05B 63/0073* (2013.01); *E05B 15/006* (2013.01); *E05B 47/00* (2013.01); *E05B 47/0012* (2013.01); *E05B 47/02* (2013.01); *E05B 2047/0094* (2013.01); *Y10T 70/7136* (2015.04); *Y10T 70/7486* (2015.04)

(58) Field of Classification Search
CPC ..... Y10T 292/34; Y10T 292/23; Y10T 292/0936; Y10T 292/0999; Y10T 70/625; Y10T 70/65; Y10T 70/7062; Y10T 70/5155; Y10T 70/5009; Y10T 70/7136; Y10T 70/7486; E05B 47/00; E05B 47/0001; E05B 47/0012; E05B 47/02; E05B 47/0002; E05B 2047/0094; E05B 2047/0058; E05B 47/026; E05B 63/0073; E05B 15/006
USPC ..... 70/279.1–283.1, 278.7, 271, 275, 277, 70/263–265; 292/251.5, 288, 289, 259 R, 292/258, 129, 177
See application file for complete search history.

(56) References Cited

U.S. PATENT DOCUMENTS 284,961 A * 9/1883 Hill ..... 292/259 R
288,028 A * 11/1883 Coultaus ..... 292/75
(Continued)

FOREIGN PATENT DOCUMENTS

DE 101 06 674 A1 8/2002
DE 10106674 A1 * 8/2002 ..... E05B 47/02
(Continued)

OTHER PUBLICATIONS

European Search Report for EP 12199456.0, dated May 7, 2013.

*Primary Examiner* — Suzanne Barrett
*Assistant Examiner* — Morgan McClure
(74) *Attorney, Agent, or Firm* — Sughrue Mion, PLLC

(57) ABSTRACT

The invention relates to an electrically operable locking device for locking a gate. The electrical lock has a frame for mounting the locking device to the gate, and a housing slidably movable with respect to the frame between an upper position and a lower position and comprising a drop bolt arranged to move between an extended drop bolt position and an retracted drop bolt position and a mechanical locking mechanism arranged to lock and unlock the housing to the frame and comprising a key-operated cylinder lock to unlock the housing to the frame. The gate is locked if said housing is in the lower position and said drop bolt is in the extended position. The locking device further has a resilient element positioned between the frame and the housing and arranged to lift the housing relative to the frame when the housing is unlocked from the frame by operation of the key-operated cylinder lock.

20 Claims, 8 Drawing Sheets

(51) Int. Cl.
*E05B 47/02* (2006.01)
*E05B 15/00* (2006.01)

(56) References Cited

U.S. PATENT DOCUMENTS

| | | | | | |
|---|---|---|---|---|---|
| 315,681 | A | * | 4/1885 | Von Hollen | 292/259 R |
| 608,321 | A | | 8/1898 | Carleton | |
| 643,850 | A | * | 2/1900 | Rogers | 292/181 |
| 648,299 | A | * | 4/1900 | Reeves | 292/178 |
| 658,122 | A | * | 9/1900 | Rogers | 292/181 |
| 765,658 | A | * | 7/1904 | Beseler | 292/258 |
| 777,408 | A | * | 12/1904 | Fletcher | 292/182 |
| 834,398 | A | * | 10/1906 | McKenzie | 292/163 |
| 1,054,386 | A | * | 2/1913 | Barton | 292/288 |
| 1,401,018 | A | * | 12/1921 | Ward | 70/9 |
| 1,459,445 | A | * | 6/1923 | Elderton et al. | 24/523 |
| 2,247,562 | A | * | 7/1941 | Santen | 74/59 |
| 3,111,340 | A | * | 11/1963 | Spencer | 292/229 |
| 3,143,369 | A | * | 8/1964 | Adams | 292/288 |
| 3,239,261 | A | * | 3/1966 | Bryson et al. | 292/75 |
| 3,796,071 | A | * | 3/1974 | Crepinsek | 70/32 |
| 4,050,723 | A | * | 9/1977 | Papadatos | 292/164 |
| 4,489,968 | A | * | 12/1984 | Easley | 292/340 |
| 4,491,354 | A | * | 1/1985 | Williams | 292/148 |
| 4,601,503 | A | * | 7/1986 | Wicks, Sr. | 292/259 R |
| 4,630,853 | A | * | 12/1986 | Bell | 292/258 |
| 4,633,688 | A | | 1/1987 | Beudat et al. | |
| 4,659,121 | A | | 4/1987 | McGee | |
| 4,669,767 | A | * | 6/1987 | Leto | 292/259 R |
| 4,724,690 | A | * | 2/1988 | Dunphy et al. | 70/129 |
| 4,779,910 | A | * | 10/1988 | Dameron | 292/259 R |
| 4,790,578 | A | * | 12/1988 | Barrera | 292/148 |
| 4,796,445 | A | * | 1/1989 | Norden, Jr. | 70/94 |
| 4,799,719 | A | * | 1/1989 | Wood | 292/144 |
| 5,284,036 | A | * | 2/1994 | Rosenbaum | 70/14 |
| 5,358,293 | A | * | 10/1994 | Bradley et al. | 292/288 |
| 5,398,982 | A | * | 3/1995 | Watson, Jr. | 292/259 R |
| 5,433,093 | A | * | 7/1995 | Sooth | 70/56 |
| 5,473,922 | A | * | 12/1995 | Bair et al. | 70/416 |
| 5,593,141 | A | * | 1/1997 | Cain et al. | 256/26 |
| 5,595,075 | A | * | 1/1997 | Chen | 70/95 |
| 5,664,812 | A | * | 9/1997 | Marinoni | 292/153 |
| 5,741,033 | A | * | 4/1998 | Everett | 292/289 |
| 5,832,758 | A | * | 11/1998 | White | 70/218 |
| 5,934,116 | A | * | 8/1999 | Moore | 70/212 |
| 6,065,785 | A | * | 5/2000 | Mantarakis et al. | 292/181 |
| 6,176,042 | B1 | * | 1/2001 | Rossman et al. | 49/463 |
| 6,192,723 | B1 | * | 2/2001 | Brownell, Sr. | 70/97 |
| 6,354,639 | B1 | * | 3/2002 | Minter et al. | 292/142 |
| 6,471,264 | B1 | * | 10/2002 | Ryan | 292/338 |
| 6,477,872 | B1 | * | 11/2002 | Denton, Jr. | 70/129 |
| 6,481,158 | B1 | * | 11/2002 | Marks | 49/57 |
| 6,666,435 | B2 | * | 12/2003 | Blosfelds | 256/73 |
| 6,834,896 | B2 | * | 12/2004 | Smith | 292/259 R |
| 7,278,663 | B2 | * | 10/2007 | Witchey | 292/259 R |
| 7,325,847 | B1 | * | 2/2008 | Tanner | 292/339 |
| 7,591,157 | B2 | * | 9/2009 | O'Neill et al. | 70/118 |
| 7,950,702 | B1 | * | 5/2011 | Adams | 292/1 |
| 8,186,729 | B2 | * | 5/2012 | Dudley | 292/201 |
| 8,276,317 | B2 | * | 10/2012 | Williams et al. | 49/394 |
| 8,505,989 | B2 | * | 8/2013 | Wells | 292/251.5 |
| 8,627,693 | B1 | * | 1/2014 | Haber | 70/14 |
| 8,876,178 | B1 | * | 11/2014 | Minter et al. | 292/336.3 |
| 2003/0226384 | A1 | * | 12/2003 | Shedd et al. | 70/107 |
| 2005/0166647 | A1 | * | 8/2005 | Walls et al. | 70/107 |
| 2005/0194797 | A1 | * | 9/2005 | Radel | 292/288 |
| 2005/0199025 | A1 | * | 9/2005 | West | 70/277 |
| 2008/0115545 | A1 | * | 5/2008 | Schumm | 70/107 |
| 2008/0136585 | A1 | * | 6/2008 | Eskildsen et al. | 340/5.7 |
| 2008/0184749 | A1 | * | 8/2008 | Alber et al. | 70/103 |
| 2008/0223093 | A1 | * | 9/2008 | Amir | 70/283.1 |
| 2010/0132262 | A1 | * | 6/2010 | Talpe | 49/394 |
| 2010/0281933 | A1 | * | 11/2010 | Barrieau | 70/263 |
| 2011/0148126 | A1 | * | 6/2011 | Macernis | 292/251.5 |
| 2011/0193354 | A1 | * | 8/2011 | Simmonds | 292/251.5 |
| 2014/0084602 | A1 | * | 3/2014 | Crosse | 292/189 |
| 2014/0215924 | A1 | * | 8/2014 | Evans | 49/394 |
| 2014/0225383 | A1 | * | 8/2014 | Simmonds et al. | 292/238 |
| 2014/0319850 | A1 | * | 10/2014 | Berger et al. | 292/177 |

FOREIGN PATENT DOCUMENTS

| | | | |
|---|---|---|---|
| DE | 20 2012 002 841 | U1 | 6/2012 |
| EP | 1 907 712 | | 1/2007 |
| FR | 2 967 436 | A1 | 5/2012 |
| WO | 87/04213 | A1 | 7/1987 |

* cited by examiner

ELECTRICAL LOCKING DEVICE WITH FAIL-SAFE EMERGENCY RELEASE

CROSS-REFERENCE TO RELATED APPLICATION

This application relates to and claims the benefit of priority from European Patent Application number 12199456.0, filed on Dec. 27, 2012, the entire disclosure of which is incorporated herein by reference.

TECHNICAL FIELD

The present invention relates to electrical locks which are used in entry and exit passages or other access controlled areas. The invention is particularly concerned with the allowance of emergency passage through such exterior entry points under the condition of a power failure.

BACKGROUND ART

Electrically controlled bolt locks are commonly used in many security applications. The flexibility provided by an electric lock assembly allows the opening and closing of the lock to be remotely controlled from a guard station to allow limited access to a facility.

Such electrically controlled locks are known from U.S. Pat. No. 4,799,719, which discloses a motor operated lock wherein the motor is translated when the motor shaft rotates, the motor shaft acting as the bolt of the lock and engaging or disengaging the door to lock or unlock the door. The motor is located on a fixed platform and is moved by the cooperation of a nut affixed to the platform and a threaded portion of the motor shaft. The assembly may be located inside or exterior to the wall and may be adapted for easy removal. The motor direction and travel limits are controlled by an appropriate electrical circuit. The described lock uses a motor to drive a deadbolt into and out of a door. The motor is actuated in a first direction to cause a rotation of the motor shaft, which is then converted into a linear, translational motion which is in turn transmitted to the bolt which is projected through the door jamb and into the door. The travel of the deadbolt into the door is discontinued on the signal of a feedback switch connected to an appropriate moving member to sense when the lock is fully closed. When the lock is desired to be opened, the motor is actuated to run in a reverse direction and to thereby withdraw the bolt from the door, into the door jamb and the wall. The withdrawal motion of the bolt is discontinued on the signal of a second feedback switch which senses when the bolt is sufficiently withdrawn to allow the door to be opened. The motor shaft contains a threaded portion which is connected to a nut having a fixed location to allow the motor to move transversely because the rotational motion of the shaft is converted to translational motion.

In sliding bolt locking devices, particularly in those intended for outdoor use, such as with gates or exterior doors, simplicity is a major advantage. Every moving element in the device may become stuck due to entrance of water or dirt, the formation of ice, corrosion, due to temperature differences or other weather related influences and/or misuse. It is therefore a recurring concern, when designing sliding devices to keep the technical solutions as simple as possible, with the smallest possible number of moving elements.

An important drawback of the electrically operated locking devices is that in case of an error in the activation system of the extended electrically controlled bolt the access through the passage remains blocked. There is thus no emergency opening possibility provided in case of an internal failure or an external power failure. Usually, in case of power failure, the locking device needs to be physically removed from the gate (closing member) it closes off in order to allow entrance, an operation which is time consuming and requires a relatively high skill level and specialised training, which is not necessarily widespread under emergency rescue personnel.

FR 2 592 911 describes an electrically controlled lock comprising an electric motor in a fixed frame, driving a bolt. Under normal operating circumstances, the lock is opened and closed through the movement of the bolt which is driven by the electric motor. However, this lock is also equipped with an alternative in case electrically unlocking is not possible. For this purpose, the lock disposes of two cylindrical and coaxial boreholes of different diameter where the motor (largest diameter) and the bolt are positioned. The motor cannot translate as it is fixed by a compressed spring on one side and a pin on the other side. This pin is installed for reasons of security, and it can be pulled out in case of an emergency. The immediate effect is that the spring decompresses and the motor is moved along its cylindrical borehole, moving the bolt with it to a position leaving the lock open.

However, this is not an ideal solution if the lock is manually accessible from both sides. This is the case in gates (panels, closing members), which are for example comprising bars. A person on the other side of the gate can have access to the pin and may therefore be able to open the gate at all times.

Furthermore, this is also not an ideal solution if the pin is removed on a regular base. In order to re-use the lock, the electric motor and the pin always need to be pushed back into their original position, against the force of the spring which is difficult and time consuming to execute.

There remains therefore a need for an electrically operated locking device which may be unlocked independently in case the electrical operation is not operable. It is also desirable that such unlocking possibility is only provided to dedicated personnel, such as personnel belonging to emergency services.

A particular situation is the locking and unlocking of rotationally opening gates. Remote controlled opening of hinged or sliding gates is commonly used. However, a lock for these gates will either be electrically powered, leaving the gates locked upon power failure, or manually unlocked, thus nullifying the effect of remote control.

There is therefore a particular need for an electric locking device which can be combined with the remote controlled opening of rotationally or sliding hinged gates. Furthermore, a person on the other side of the gate should not be able to open the lock, yet it should be easy to access and to be unlocked by emergency services or authorized persons on either side of the gate. Finally, the electric locking device should be resistant to vandalism.

DISCLOSURE OF THE INVENTION

It is an aim of the present invention to provide an electrically operable locking device with a mechanical locking mechanism which is operable independently from the position of the electrically activated drop bolt showing the technical characteristics of the first independent claim.

In a preferred embodiment, the invention provides an electrically operable locking device for locking a gate. The locking device comprises a frame for mounting the locking device to the gate, and a housing which is slidably movable with respect to the frame between an upper position and a lower position. The housing comprises a drop bolt arranged to move between an extended drop bolt position and a retracted drop bolt position and a mechanical locking mechanism arranged to lock and unlock the housing to the frame. The mechanical locking mechanism comprises a key-operated cylinder lock to unlock the housing to the frame. The gate is locked if the housing is in the lower position and the drop bolt is in the extended position. The locking device further comprises a resilient element positioned between the frame and the housing. This resilient element is arranged to lift the housing when this is unlocked from the frame by operation of the key-operated cylinder.

The advantage of this embodiment is that there are several ways to open the gate. Under normal operation, the housing will be located in the lower position. Locking and unlocking the gate occurs by switching the drop bolt between the extended and retracted drop bolt position. In case of power failure, the housing will still be in the lower position with respect to the frame. The lock bolt will be in the extended drop bolt position with respect to the housing. The housing is therefore equipped with a mechanical locking mechanism comprising a key-operated cylinder lock which allows unlocking the housing with respect to the frame. Once the housing is unlocked to the frame the resilient member ensures that the housing remains in an unlocked state which allows the user to move the housing to the upper position. Thus, the gate is unlocked by a collaboration of two mechanisms. First, the mechanical locking mechanism allows unlocking the housing from the frame. Subsequently, the resilient element will lift the housing from the frame.

In an embodiment of the present invention, the locking device is comprising the frame as meaning the entire fixed part of the device, for being fixed to the gate, and the housing as the entire movable part of the device, and which comprises all elements attached to the housing, including the electrically powered driving mechanism for extending and retracting the bolt from the housing.

In a further preferred embodiment of the locking device according to the present invention, the frame of the locking device comprises a notch in the frame. The mechanical locking mechanism of the housing further comprises a projecting member. This projecting member is arranged to move in and out the notch of the frame in order to lock and to unlock the housing to the frame.

Following this embodiment, contact is made between the frame and the housing, by a projecting member which moves in and out of the notch. The mechanical locking mechanism is the decisive element to make or break the contact, which in turn leads to locking or unlocking of the housing. The advantage of this mechanism is that it is easy to produce, yet it is space-saving in implementation.

In another preferred embodiment of the present invention, the mechanical locking mechanism of the housing comprises an intermediary locking element which is mounted in the housing in such a way that it rotates around an axis. The projecting member described above is part of this intermediary locking element. The intermediary locking element is arranged in such a way that rotation of this element moves the projecting member in and out of the notch of the frame. Locking and unlocking the housing is therefore controlled by rotation of the intermediary locking element. This adds to the robustness of the locking device. It also allows saving space in the device.

In still another preferred embodiment of the present invention, the mechanical locking mechanism of the housing comprises a spring arranged to press the projecting member of the intermediary locking element into the notch of the frame. If the projecting member is pressed into the notch, the housing is locked with the frame. The spring is therefore used to lock the housing with the frame. The advantage of the spring is that it is an inexpensive and fail-proof method to press the projecting member into the notch. Due to the relative small size of the spring, the overall size of the mechanical locking mechanism can be reduced to a minimum.

In a further preferred embodiment of the present invention, the projecting member of the intermediary locking element is chamfered such that when the projecting member is contacting an edge of the frame when moved from the upper position towards the lower position, the projecting member is moved into the housing against the action of the spring.

This structure provides the advantage that locking is done automatically by moving the housing from the upper position to the lower position.

In still another preferred embodiment of the present invention, the intermediary locking element of the mechanical locking mechanism is rotatable about an axis in a first direction. The key-operated cylinder lock has an axis of rotation substantially perpendicular to this first direction. The perpendicular position of both axes allows an easy access to the key-operated cylinder lock. It also allows moving the projecting member of the intermediary locking element in and out of the notch of the frame in a more compact locking device. The structure further provides the advantage to convert the plane of the active member.

In another preferred embodiment of the present invention, the key-operated cylinder lock comprises a fixed mounted cylinder housing and an acting member rotatable to said cylinder housing. The acting member is arranged to act on the intermediary locking element when rotated. The acting member serves to bring a movement over to the intermediary locking element. As such, it is part of the elementary actions to unlock the housing from the frame. Unlocking the housing is initiated by turning the key in the key-operated cylinder lock. The key-operated cylinder lock will rotate, and therefore, the acting member will act on the intermediary locking element. The intermediary locking element will subsequently rotate around an axis substantially perpendicular to the axis of rotation of the key-operated cylinder lock. The intermediary locking element comprises the projecting member, which is moved out of the notch leading to the unlocking of the housing. As an additional advantage, the acting member is robust, fail-proof and space-saving.

In still another embodiment of the invention, the intermediary locking element comprises at least one pivot part and the at least one pivot part is located closer to the contact area with acting member of the cylinder lock than to the projecting member which cooperates with the notch in the frame.

This has the advantage that a limited rotation of the key in the key-operated cylinder lock creates a large rotation of the projecting member.

In yet another preferred embodiment of the present invention, the housing comprises a horizontally mounted coil spring and a spring support element. The spring support element encloses the horizontally mounted coil spring, wherein this coil spring is arranged to act between the housing and the frame to keep the housing in the upper position. Being able to keep the housing in the upper position is of practical use as it allows the user to concentrate on opening the doors of the gate without having further to worry about the locking device. There is no risk that the lock reverts for example by gravity which is useful in emergencies.

In another preferred embodiment of the present invention, the frame comprises an opening and the spring support element comprises a projection. This projection is arranged to be pressed into the opening by the coil spring when the housing is in the upper position. The advantage is that the user feels when the housing reaches the upper position. It is also an inexpensive and robust method to keep the housing in the upper position. Manual intervention is needed to remove the projection out of the opening and push the housing to the lower position.

In still another preferred embodiment of the present invention, one of the housing and the frame is provided with at least one protrusion and the other one of the housing and the frame is provided with at least one guide for accepting the protrusion. The cooperation of the protrusion and the guide is arranged to guide relative movement of the housing with respect to the frame. This brings the advantage that the moveable connection between housing and frame is substantially error free, and may readily be shielded by the housing such that it is rather inaccessible for damage or sabotage, and that it may be substantially burglar proof.

In another preferred embodiment of the present invention, the locking device comprises an electrical power cable and the housing comprises a flexible cable guide. The flexible cable guide is arranged to guide the electrical power cable. The use of a flexible cable guide avoids that the electrical power cable may become damaged or twisted by the mechanical movement of the housing with respect to the frame. This brings the advantage that the locking device maintains a high level of safety and reliability, also when the emergency access possibility has been exercised, even repeatedly.

In still another preferred embodiment of the present invention, the housing comprises a reinforced end and the frame comprises a loop. The reinforced end is arranged to cover the loop when the housing is in the lower position such that the loop is embedded in the reinforced end of the housing. As described above, the housing is unlocked by turning the key in the key-operated cylinder lock which results in the projecting member of the intermediary locking element moving out of the notch of the gate. Although this mechanism is unreachable and highly burglar proof, an upward pressure might still unhinge the housing from the frame. The function of the loop is to make it impossible to lift the housing with the aid of a crowbar or a tool which is used for a similar goal. As the loop is embedded in the reinforced end of the housing, it impedes to lever the housing. This brings the advantage that the locking device is highly burglar proof.

In an embodiment of the locking device according to the present invention the locking device comprises a frame with at least four and preferably six protrusions which protrude sideways from the frame pair wise pointing outwards in opposite directions, and the housing being provided with two longitudinal slots opening inwards from the housing exterior. The inventors have found that this arrangement is particularly convenient, simple, reliable and trouble free, and easy to produce, while it also is substantially burglar proof.

In an embodiment of the locking device according to the present invention the locking device comprises a mechanical locking mechanism operable by means of a key, preferably the mechanical locking mechanism being operable by a key-operated lock, more preferably by a cylinder lock. This brings the advantage that the possibility for the emergency opening of the gate may be restricted to personnel in possession of a key which fits the mechanism, or of a suitable passkey or master.

In an embodiment of the locking device according to the present invention, the release of the mechanical locking mechanism may be performed manually, preferably by using only one hand, more preferably using at most 3 fingers, more preferably using only thumb and index finger. This brings the advantage of excellent ergonomics, such that a person of normal ability is able to release the mechanical locking mechanism readily and quickly, which results in a faster allowance of access through the passage controlled by the gate.

In an embodiment of the locking device according to the present invention the release of the mechanical locking mechanism requires a rotational movement of at most one half circle or 180°, preferably at most 90°, more preferably at most 45°, even more preferably at most 30°, and yet more preferably at most 15°. This brings the advantage of further excellent ergonomics and quick operability, which result in a faster allowance of access through the passage controlled by the gate.

In an embodiment of the locking device according to the present invention the locking device comprises a release of the mechanical locking mechanism through a required translational movement of at most 20 mm, preferably at most 15 mm, more preferably at most 10 mm, even more preferably at most 7 mm, yet more preferably at most 5 mm. Also this feature further enhances the ergonomics and quick operability, which result in a faster allowance of access through the passage controlled by the gate.

In an embodiment of the locking device according to the present invention the access required for releasing the mechanical locking mechanism at a distance D from the end of the housing from which the drop bolt extends, whereby D is preferably at least 50 mm, more preferably at least 100 mm, even more preferably at least 150 mm, yet more preferably at least 200 mm, preferably at least 300 mm, more preferably at least 400 mm, even more preferably at least 500 mm, yet more preferably at least 600 mm. This brings the advantage that the point which needs to be accessed for releasing the mechanical locking mechanism may be provided at a distance from where the gate approaches its surrounding, what typically means it may be located in a position where it is more reachable by a wider range of people. It avoids that the personnel seeking access through the passage do not have to reach high up or low down to where the drop bolt of the locking device is protruding into the cavity provided in the surrounding of the gate. Also this feature further enhances the ergonomics and quick operability, which results in a faster allowance of access through the passage controlled by the gate.

In an embodiment of the locking device according to the present invention the locking device comprises a resilient element provided for, upon release of the mechanical locking mechanism, by the relaxation of the resilient element urging the housing noticeably out of its extended or lower position. This brings the advantage that the operator is immediately made aware of successfully having released the mechanical locking mechanism, clearly signalling that the housing is ready to be moved into its retracted or upper position. By preference, the mechanical locking mechanism is also moved by the relaxation of the resilient member, e.g. because the mechanical locking mechanism is a part of the housing, such that the operator of the mechanical locking mechanism also feels the movement and is thus also in a tangible way signalled that the housing is ready to be moved further into its retracted or lower position. Also this feature brings the advantage of a faster allowance of access through the passage controlled by the gate.

In an embodiment of the locking device according to the present invention the locking device comprises a drop bolt whereby the throw length of the drop bolt relative to the housing is at least 50 mm, preferably at least 60 mm, more preferably at least 70 mm, even more preferably at least 80 mm, yet more preferably at least 90 mm, preferably at least 100 mm, more preferably at least 110 mm, even more preferably at least 115 mm, and optionally at most 200 mm, preferably at most 150 mm. The longer the drop bolt, the deeper it may be protruding into the cavity of a bolt reception element, and the more difficult it is for an unauthorized person to free the extended drop bolt from the cavity, whereby the gate may become released and the person may gain access through the passage. Another advantage of a longer drop bolt is, when the drop bolt is penetrating into a cavity into the ground, that a wider tolerance may be provided between the underside of the housing and/or of the gate and the ground level, such that the risk is reduced that, during frost periods, the ground level increases due to the frost and possibly jams the gate in its locked position.

In an embodiment of the locking device according to the present invention the distance between the lower position of the housing and the upper position of the housing is at least 5 mm more than the throw length of the drop bolt relative to the housing. This brings the advantage that when the housing has been moved into the upper position, with the drop bolt still extended from the housing, is readily recognisable as releasing the gate. This enhances the understanding of the personnel that the gate may be moved and access through the passage has become possible, avoiding any confusion and/or hesitation. Also this further improves the faster gaining of access through the passage controlled by the gate.

In an embodiment of the locking device according to the present invention the housing is manually movable between the lower position and the upper position, preferably by only one hand. This brings the advantage of excellent ergonomics, and ready operability by a person with normal ability.

In an embodiment of the locking device according to the present invention the locking device further comprises a means for removably anchoring the housing in the upper position, preferably the anchoring being manually removable, more preferably by only one hand. This brings the advantage that the housing may not readily return into the lower position such as by gravity, for instance when the operator removes his hand or hands from the housing. The housing thus clearly remains in the upper position, which typically is readily recognisable by personnel even at a significant distance from the gate, indicating that the gate is released, which may be important information for other members of an emergency crew. It is thereby preferred that also the return of the housing into the lower position enjoys good ergonomics and may be performed by a person of normal ability.

In an embodiment of the locking device according to the present invention the mechanical locking mechanism is provided for locking the housing upon its return into the lower position and requiring to be released before again allowing the mechanical movement of the housing away from the lower position. This brings the advantage that no further action needs to be performed in order to restore the situation in which the gate is locked, apart from returning the housing into the lower position. The original locked position of the gate is thus readily restorable. By preference, if the release of the mechanical locking mechanism requires a key, the key does not need to be present for allowing the return of the housing into the lower position. This brings the advantage that the operator who has released the mechanical locking mechanism may immediately after the release recover his key from the mechanical locking mechanism. It avoids that the key has to remain in the locking mechanism, typically unguarded and therefore prone for being stolen or copied for later abuse.

An advantage of the locking device according to the present invention is that it provides a mechanically unlocking possibility for the gate which is and remains operable independently from the position of the electrically activated bolt relative to the housing, and which remains operable also with any internal or external damage of the electrically activated bolt mechanism or the power supply thereto. Such situations may for instance occur in case of fire, when power supply may have been cut and access through a gate locked with the locking device may nevertheless be critical to fire brigade or other emergency personnel in order to bring people or animals into safety, more effectively extinguish the fire or even more effectively fight any other life threatening hazards.

The housing, wherein the electrically activated bolt is located, is made mechanically movable relative to the panel/gate to which it is fixed by means of the frame, such that, when for instance installed in a vertical position, it is possible to lift the locked bolt manually from the cavity by lifting the housing upwards. The present invention may be used in other directions or positions than a vertical installation and is thus not limited thereto.

The locking device according to the present invention brings the advantage, once the mechanical locking mechanism is released, that the housing may be moved readily, very quickly and with very good and convenient ergonomics. Moving the entire housing including the extended bolt is also much more intuitive to a person as compared to other possible solutions which may mechanically pull or retract the bolt back into the housing. Such solutions would inevitably need to be hidden inside the housing and would thus not readily be recognisable. Nor would such solutions provide as good ergonomics, or an evenly quick and fast operation as compared to the movement of the housing. The housing is also typically sufficiently large to provide a good grip for one or even two hands of a person. The housing may also readily be kept sufficiently lightweight such that its movement should not require any excessive force and may be performed by any person having a normal level of ability.

BRIEF DESCRIPTION OF THE DRAWINGS

The invention will be further elucidated by means of the following description and the appended figures.

MODES FOR CARRYING OUT THE INVENTION

Figure 1:
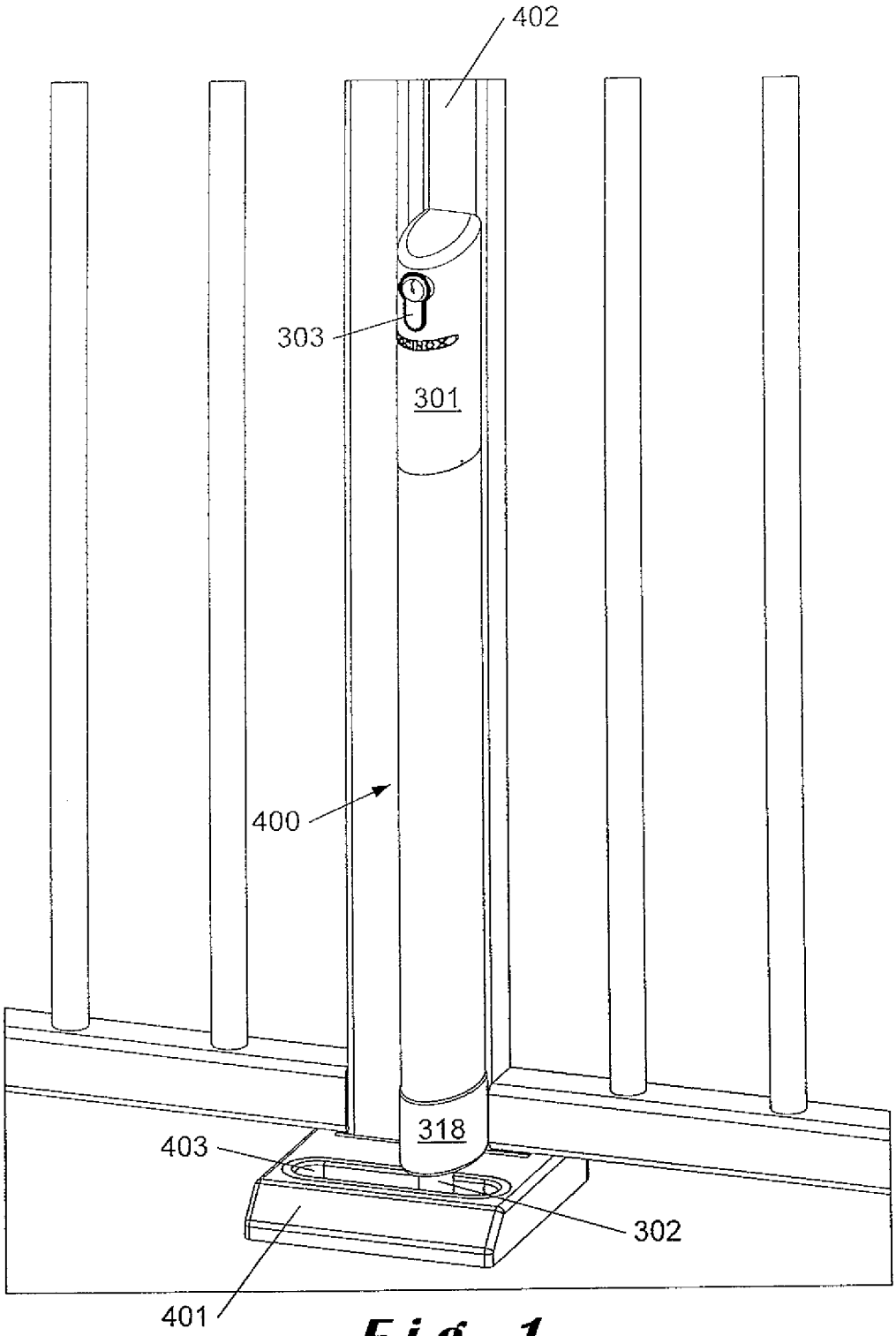
FIG. 1 shows a frontal perspective view of the locking device 400 mounted to a gate according to a preferred embodiment of the present invention, in a locked position.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions do not necessarily correspond to actual reductions to practice of the invention.

Furthermore, the terms first, second, third and the like in the description and in the claims, are used for distinguishing between similar elements and not necessarily for describing a sequential or chronological order. The terms are interchangeable under appropriate circumstances and the embodiments of the invention can operate in other sequences than described or illustrated herein.

Moreover, the terms top, bottom, over, under, upper, lower, vertical and horizontal and the like in the description and the claims are used for descriptive purposes and not necessarily for describing relative positions. The terms so used are interchangeable under appropriate circumstances and the embodiments of the invention described herein can operate in other orientations than described or illustrated herein.

Furthermore, the various embodiments, although referred to as "preferred" are to be construed as exemplary manners in which the invention may be implemented rather than as limiting the scope of the invention.

The term "comprising", used in the claims, should not be interpreted as being restricted to the elements or steps listed thereafter; it does not exclude other elements or steps. It needs to be interpreted as specifying the presence of the stated features, integers, steps or components as referred to, but does not preclude the presence or addition of one or more other features, integers, steps or components, or groups thereof. Thus, the scope of the expression "a device comprising A and B" should not be limited to devices consisting only of components A and B, rather with respect to the present invention, the only enumerated components of the device are A and B, and further the claim should be interpreted as including equivalents of those components.

The invention is now further illustrated by the accompanying drawings, without being limited thereto.

FIG. 1 shows a locking device 400 according to an embodiment of the present invention which is mounted to a gate 402 which may be a hinged closing member or a sliding closing member. The housing 300 of the locking device 400 is displayed in its lower or extended position and the electrically-driven drop bolt 302 is displayed in the extended position with respect to the housing 300. The drop bolt 302 projects preferably up to 120 mm into the cavity 403 of a ground stop or a bolt reception element 401.

The locking device 400 is provided with a reinforced end 318, which is strongly fixed to the housing 300, to prevent disabling the drop bolt 302 by means of for instance a crowbar. The upper part of the housing comprises a mechanically locking system 301. The housing 300 is by preference provided with a key-operated cylinder lock 303 for manually opening the gate 402 as explained later.

Figure 2:
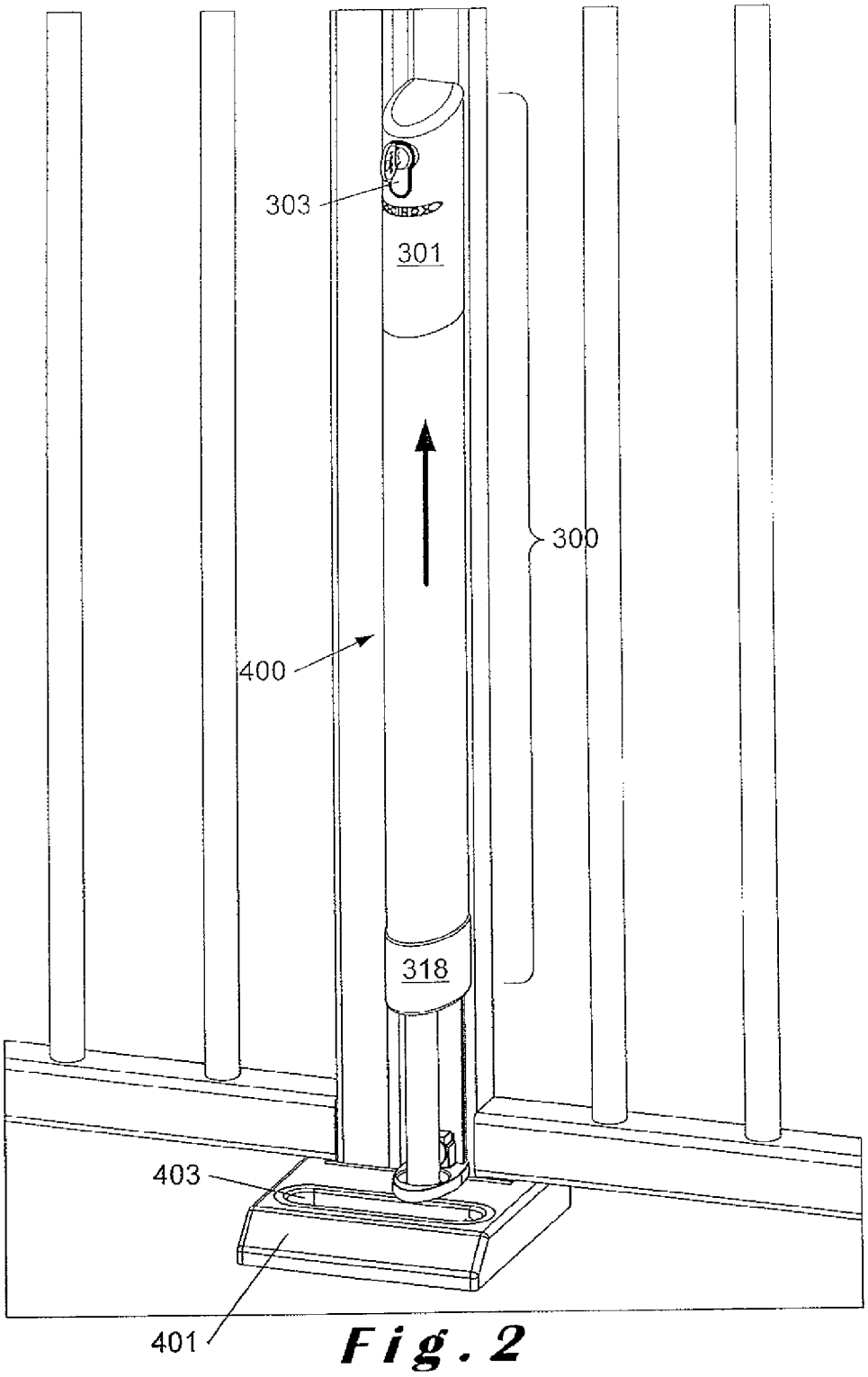
FIG. 2 shows the same view of the same locking device 400 as in FIG. 1, now in an unlocked position.

FIG. 2 shows in perspective view the housing 300 having been moved in its upper or retracted position. In this position the gate 402 is released for opening without the drop bolt 302 having been retracted into the housing 300, a condition which may be very useful in case of emergency or in case of power failure.

Figure 3:
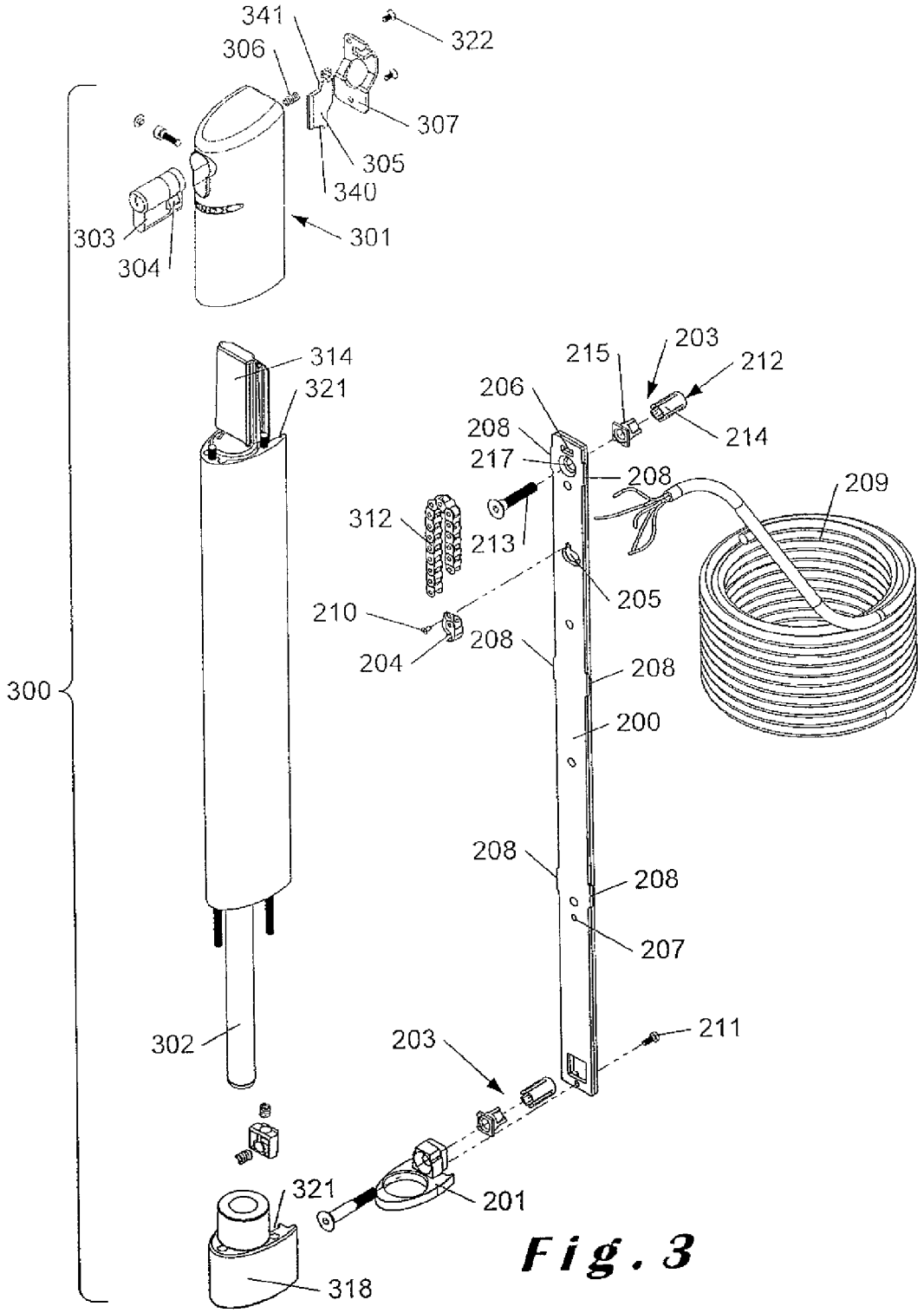
FIG. 3 shows an exploded view of the same locking device 400 as in FIG. 1.

FIG. 3 illustrates in an exploded view the inside elements of the housing 300 and the frame 200. The housing 300 comprises two vertically sliding slots 321 as guides which allow the housing 300 and its entire content to slide longitudinally over the frame 200 with the preferably 6 notches or protrusions 208 extending sideways from the frame and fitting into the sliding slots 321 of the housing 300.

The frame 200 is preferably mounted to the gate 402 with at least two mounting devices 203, comprising an externally threaded bolt piece 213 and an internally threaded nut piece 212 provided to be inserted through an opening 217 in the frame 200, whereas an intermediate blocking piece 215 prevents the nut piece 212 from rotating when the bolt piece 213 is screwed into the nut piece 212, whereby the internally threaded nut piece 212 comprises a plurality of expandable parts 214, and the intermediate blocking piece 215 is provided to cooperate to expand the expandable parts 214 when the bolt piece 213 is screwed and tightened. The two mounting devices 203 are hidden when the housing 300 is in its extended position.

Figure 4:
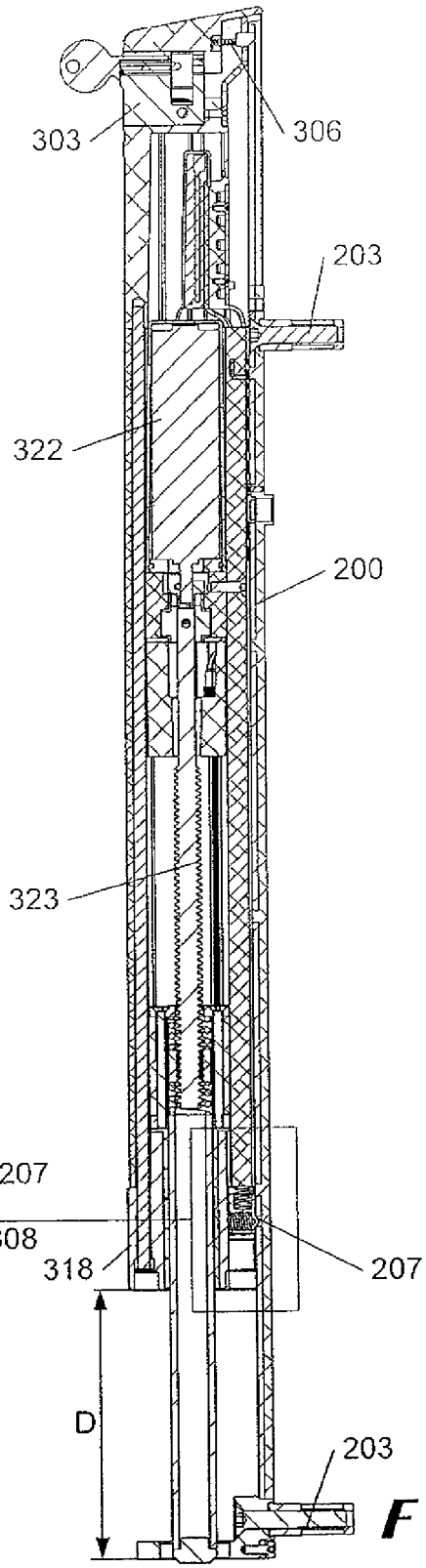
FIG. 4 shows a longitudinal cross section of the same locking device 400 in an unlocked position, as also shown in FIG. 2.

The housing 300 is also connected to the frame 200 by a hollow flexible cable guide 312 and its fixing 204 to the frame, for routing and guiding the power cable 209 from the power control point to the electrical motor 322 which can be seen on FIG. 4 and which is provided for extending and retracting the electrical bolt 302.The hollow flexible cable guide 312 is preferably made from plastic.

On the end of the frame 200 where the housing 300 is provided with the drop bolt 302, is a loop 201 intended for being mounted with a mounting device 203 through opening 217 in the frame to the gate. This loop 201 is preferable made of high strength steel and is engaging with the housing 300 when this is in the lower position, in order not to allow any significant lateral movement of the locking device 400 relative to the gate 402 when the electrical drop bolt 302 is in the extended position relative to the housing 300 and the housing is also in the lower position.

The loop 201 is embedded in the reinforced end 318 of the housing 300, when the housing is in the lower position with respect to the frame 200. The presence of the loop makes it impossible to wring a tool between the reinforced end 318 and the drop bolt 302 and dislodge the housing 300 from the frame 200.

FIG. 4 illustrates in side view a longitudinal cross section of the locking device 400 with the housing 300 shown in its retracted or upper position and the electrical drop bolt 302 in its locked or extended position. The locking device 400 is designed such that the longitudinal movement of the housing 300 is longer than the longitudinal length of the protrusion of the electrical bolt 302. In this way the gate 402 becomes fully unlocked when the housing has been moved from its lower position into its upper position.

The housing 300 comprises an electrical motor 322 which in a preferred embodiment consumes only 11 Watt. At rest, the entire locking device may consume only 0.2 Watt. Advantageously this electrical motor 322 is not continuously powered, unlike known solenoid powered lock devices. The electrical motor 322 converts a rotation of the threaded motor shaft 323 into the translational motion of the drop bolt 302.

Figure 5:
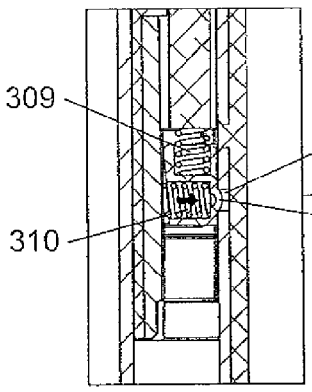
FIG. 5 shows an enlargement of a detail of a system of coil springs and spring support element with the housing 300 in its upper position.

FIG. 5 is showing an enlarged detail from FIG. 4, and illustrates in side view how the housing 300 is removably anchored in its retracted or upper position. The housing 300 is provided with an anchoring mechanism with a vertically mounted and compressed helical spring 309 and a horizontally mounted and compressed helical spring 310. The vertically mounted spring 309 causes a small but noticeable longitudinal movement of the housing 300 upwards relative to the frame, as soon as the mechanical locking mechanism keeping the housing 300 in its extended or lower position has been released. At the end the horizontally mounted spring 310 pushes a transverse lip or projection 308 into notch or opening 207 provided in the frame 200, whereby the housing 300 is removably anchored to the frame 200 in its retracted or upper position.

Figure 6:
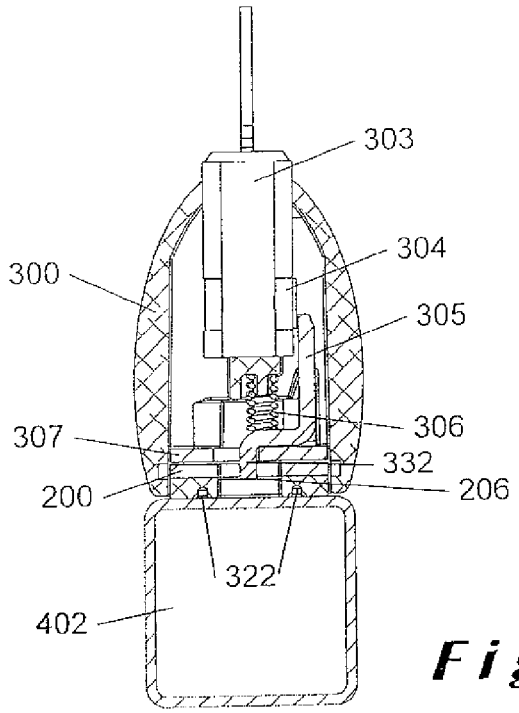
FIG. 6 shows a cross section of the mechanical locking mechanism, as seen from the bottom.

FIG. 6 illustrates in bottom view a cross section of the locking device 400, showing how the housing 300 is locked to the frame 200 in its extended or lower position. The housing 300 is locked to the frame 200 through the lip (projecting member) 332 of the intermediary locking element 305 fitting into a notch 206 in the frame 200.

In this way the housing 300 is locked with respect to gate 402 when it is positioned in its extended or lower position. The intermediary locking element 305 is shown in its locked position and is kept in that position by the pressure from the horizontally mounted and compressed helical spring 306.

Figure 7A:
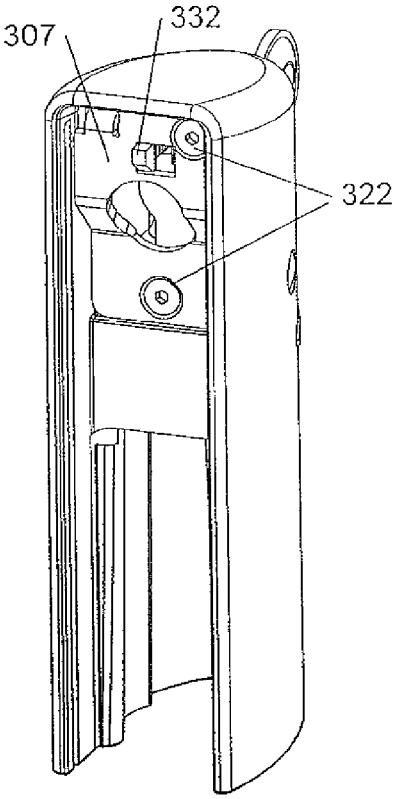
FIGS. 7*a* and 7*b* illustrate a backwards perspective view of the housing 300 and the rear cover element 307.
Figure 7B:
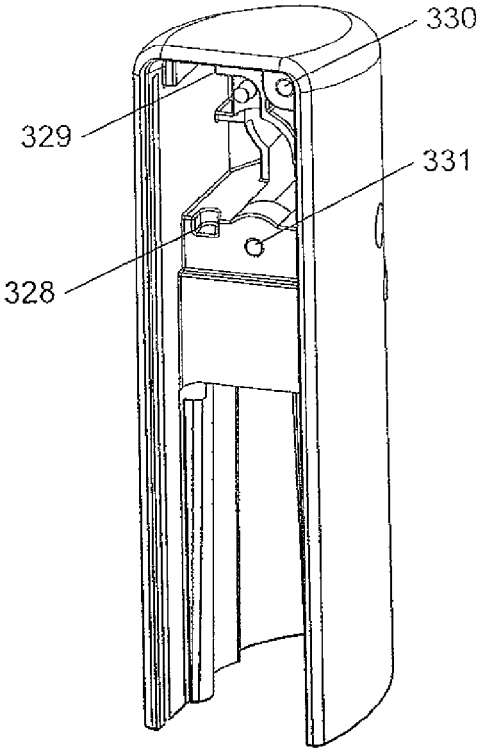

FIGS. 7*a* and 7*b* illustrate the rear view of the mechanically locking system 301 of the housing 300. In FIG. 7*a*, the rear cover element 307 is still in place, fixed by two screws 322, and the lip (projecting member) 332 of the intermediary locking element 305 is sticking through the cover element 307 such that it may reach into the opening (notch) 206 which is provided in the frame 200, as shown in FIG. 3.

In FIG. 7*a* is also shown that the projecting element 322 may be chamfered. This ensures that when the housing is in an unlocked position with the projecting member no longer in contact with the frame, for example the upper position, and the housing is moved towards the lower position with respect to the frame that the projecting element 322, when reaching the frame, is moved inwardly into the housing against the action of the spring 306.

In FIG. 7*b*, the cover element 307 and intermediary locking element 305 have been removed, such that the lower notch 328 and the upper notch 329 in the cover element 307 become visible. The lower notch 328 receives the lower hub 340 provided on the intermediary locking element 305 as shown in FIG. 3. The upper notch 329 of the cover element 307 receives the upper hub 341 of the intermediary locking element 305. These two hubs 340 and 341 define the rotational axis I around which the intermediary locking element 305 is able to pivot.

Figure 8A:
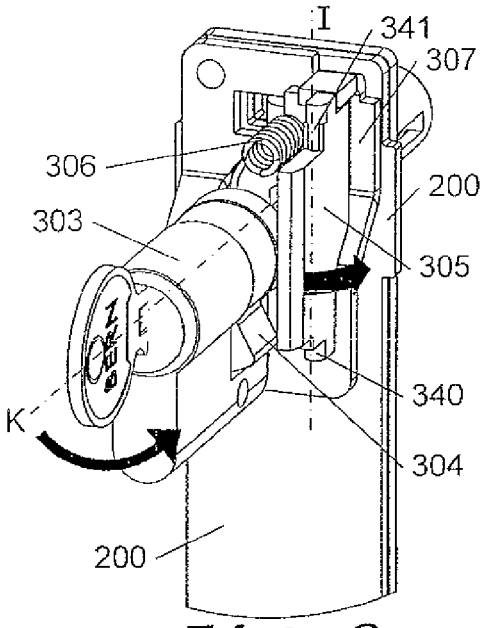
FIG. 8*a* illustrates a frontal perspective view of the key-operated cylinder lock 303 and other elements for unlocking the housing 300.

FIG. 8*a* illustrates in front perspective view the locking system 301 for locking and unlocking the housing 300 relative to the frame 200. The housing 300 is locked through intermediary locking element 305 rotatable around its longitudinal axis I.

As explained above, turning the key in the key-operated cylinder lock 303 initiates the unlocking of the housing. The key-operated cylinder lock 303 will rotate, causing the acting member 304 to act on the intermediary locking element 305. As described above, the intermediary locking element 305 pivots around a rotational axis I defined by the pivot points where the hubs 340,341 of the intermediary locking element are mounted to the notches 328, 329 respectively. The intermediary locking element 305 will rotate around an axis I which is substantially perpendicular to the axis of rotation K of the key-operated cylinder lock 303. The intermediary locking element 305 comprises the projecting member 332, which is moved out of the notch 206 leading to the unlocking of the housing 300.

The gate is unlocked by a collaboration of two mechanisms. The mechanical locking mechanism 301 allows unlocking the housing 300 from the frame 200. However, once the housing is unlocked, the resilient element 309 will lift the housing 300 from the frame 200, preventing the projecting member 332 to move into the notch 206.

The housing 300 may become unlocked from the frame 200 by rotating the intermediary locking element 305 around its longitudinal axis I by means of a key-operated cylinder lock 303 operable from the front side of the mechanical locking mechanism 301, as shown on FIGS. 1-4.

Figure 9A:
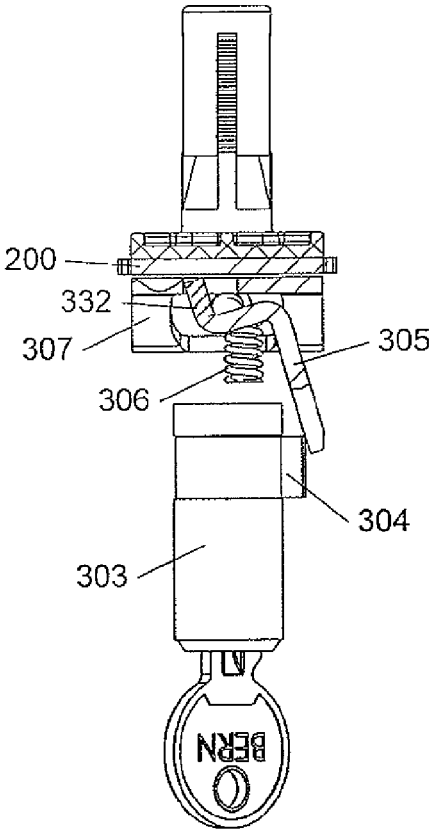
FIG. 9*a* shows a top view of the same key-operated cylinder lock 303 and other elements.

By turning the key less than 15° counter clockwise around its axis K, the lip or acting member 304 of the cylinder lock 303 pushes the intermediary locking element 305 out sideways, and by the intermediary locking element 305 pivoting around its axis I the lip or projecting member 332 of the intermediary locking element 305 is removed out of the notch 206 of the frame 200, against the pressure of the spring 306. This released position of the mechanical locking mechanism is displayed in the top view shown in FIG. 9*a*.

As explained above, a second mechanism becomes active when the projecting member 332 is released from the notch 206, for example by turning the key of the key-operated cylinder lock 303. The resilient element 309 pushes the housing upwards over a distance L. This prevents the projecting member 332 of moving back into the notch 206. The projecting member 332 is at that moment pushed towards the frame 300 by the spring 309. The fact that the housing is lifted over a distance L relative to the frame is an indication to the user that the housing has to be moved further relative to the frame to further unlock the locking device. In order to open the gate 402, the user will then further move the housing 300 to the upper position.

Figure 8B:
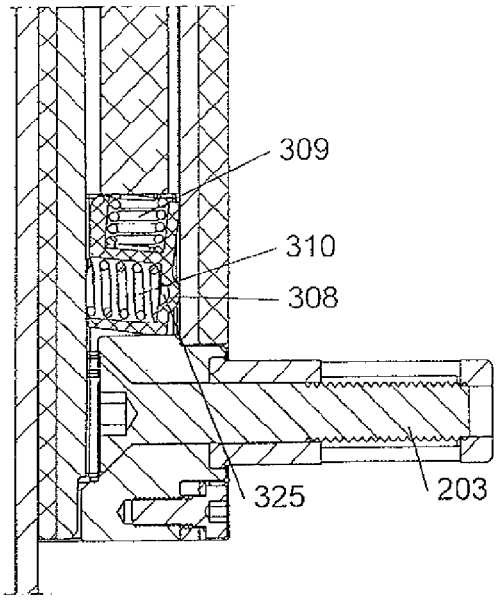
FIG. 8*b* shows a longitudinal cross section of the system of coil springs and spring support element at the start of turning the key of the key-operated cylinder lock 303 counter clockwise.
Figure 9B:
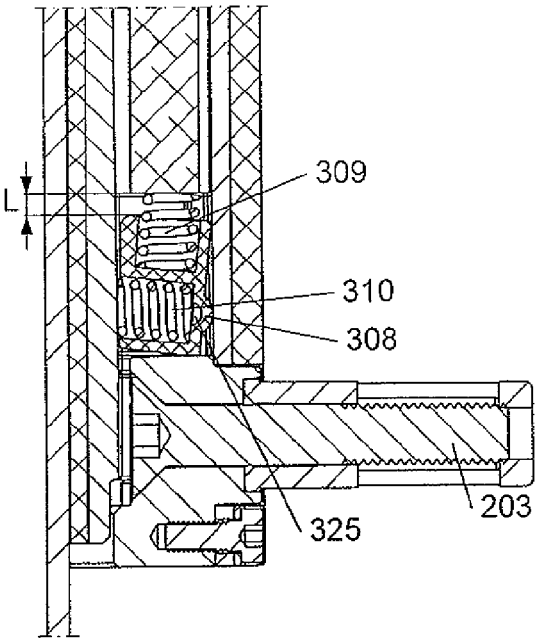
FIG. 9*b* shows in side view a longitudinal cross section of the system of coil springs and spring support element after the key of the key-operated cylinder lock 303 has been turned to release the mechanical locking mechanism 301.

FIGS. 8*b* and 9*b* illustrate in side view of a longitudinal cross section of a detail of the locking device, how a resilient member 309, in the drawing shown as helical spring 309, upon release of the mechanical locking system, is provided for pushing the housing 300 upwards in the drawing by a distance L, and thus urging the housing 300 noticeably out of its extended or lower position relative to the frame. FIG. 8*b* illustrates in side view the situation before unlocking the housing 300 in its extended position from the frame and before releasing the mechanical locking mechanism. The horizontally mounted and compressed spring 310 pushes a transverse lip 308 against the frame 200. FIG. 9*b* illustrates in side view the situation after unlocking the housing 300 in its extended position from the frame, i.e. after release of the mechanical locking mechanism. FIG. 9*b* shows how the vertically mounted helical spring 309 is relaxed and lifts the housing 300 over a length L relative to the frame 200.

Figure 10A:
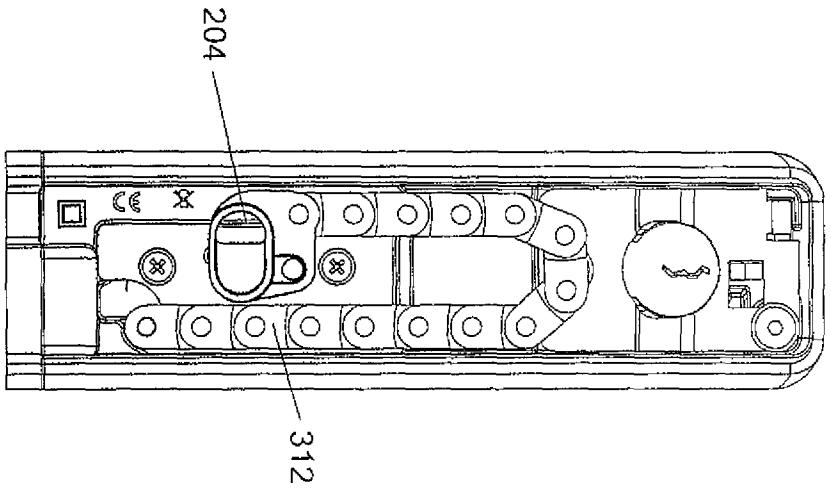
FIG. 10*a* shows a longitudinal cross section of the housing 300 illustrating the hollow flexible cable guide 312 in the lower position of the housing 300.
Figure 10B:
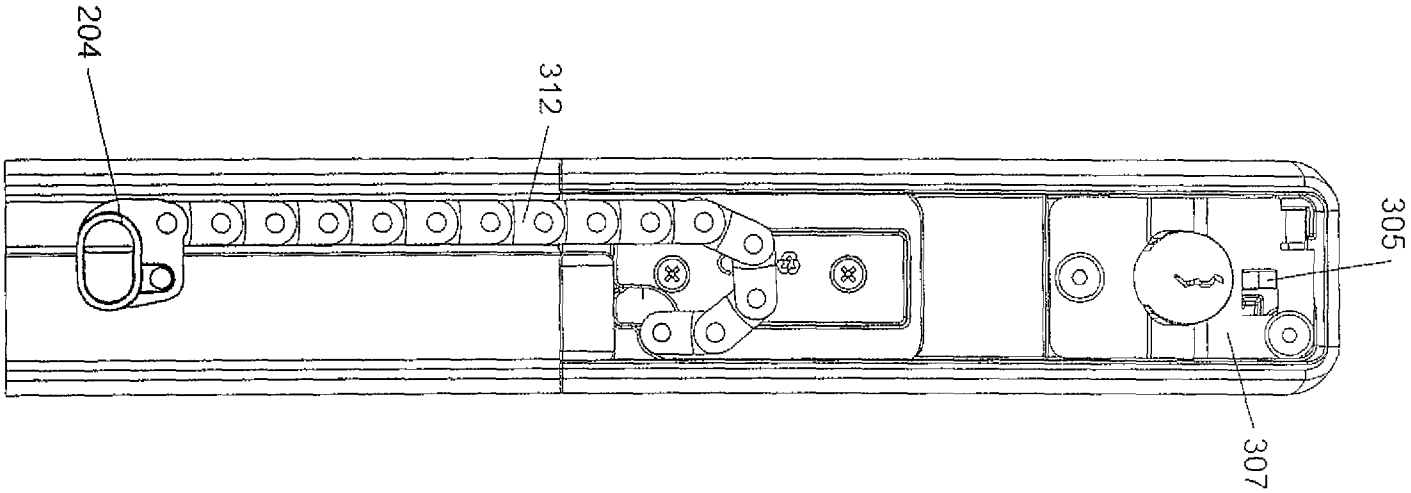
FIG. 10*b* shows a longitudinal cross section of the housing 300 illustrating the hollow flexible cable guide 312 in the upper position of the housing 300.

FIG. 10*a* shows the hollow flexible cable routing 312 with the housing 300 in its extended position, and FIG. 10*b* shows the hollow flexible cable routing 312 with the housing 300 in its retracted position. The hollow flexible cable routing 312 is connected to the frame 200 with a hollow flexible cable slot 204. The hollow flexible cable routing 312 protects the power cable 209 to the electrical motor 322 on its path from where the cable passes through the frame 200 towards the electrical motor 322, from becoming twisted or damaged by the movement of the housing 300 relative to the frame 200.

Figure 11:
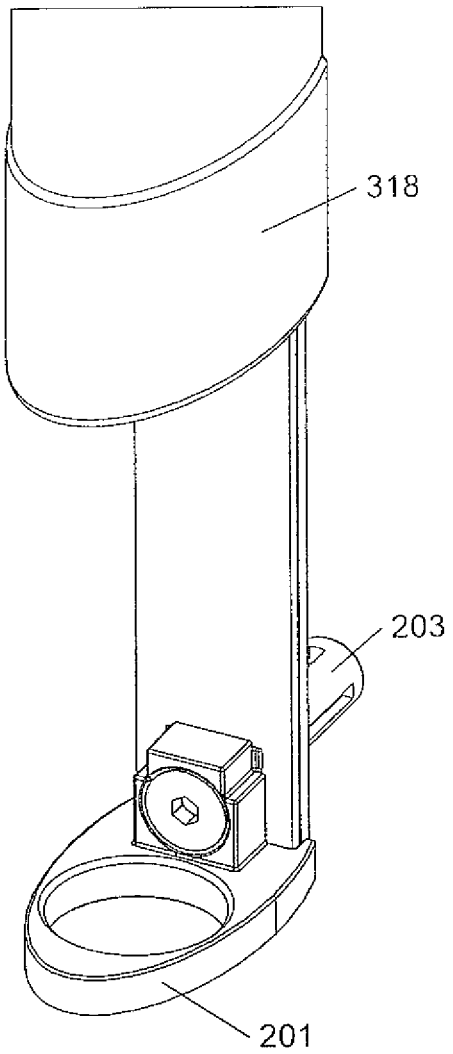
FIGS. 11 and 12 show two frontal perspective views of the loop 201 and the reinforced end 318, FIG. 11 as seen from above right and FIG. 12 from below right, whereby in each figure the housing 300 is shown in the upper position relative to the frame, and the bolt 302 is shown in retracted position relative to the housing.
Figure 12:
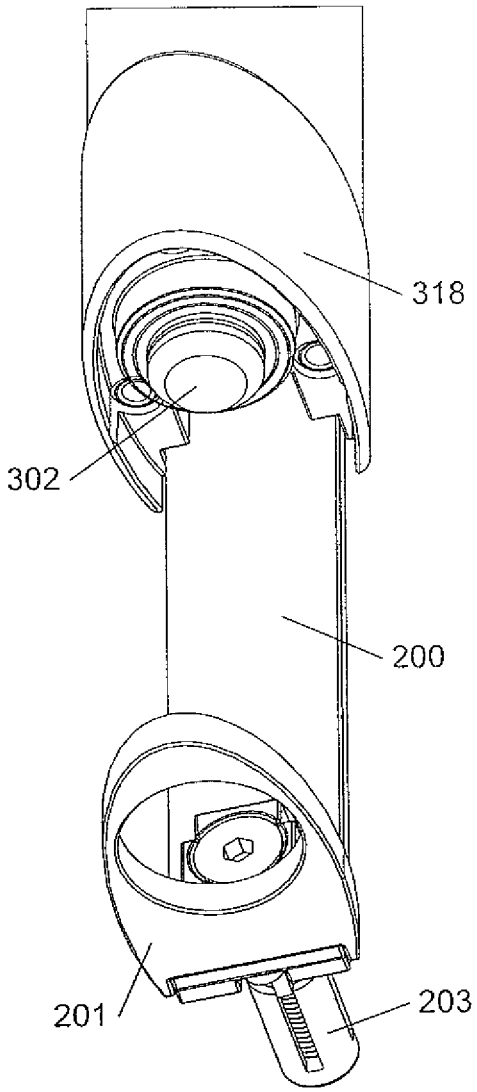

FIGS. 11 and 12 illustrate in top and bottom perspective views the reinforced end 318 of the housing 300, with the housing 300 in its retracted position and the bolt 302 shown in its retracted position relative to the housing 300. On the frame 200 is mounted a loop 201 by means of a quick fixing device 203 which is reaching through the frame 200 for mounting the frame 200 and the loop 201 to the gate 402 behind the frame 200. When the housing 300 and its reinforced end 318 are returned into the extended position of the housing 300, this loop 201 engages with the reinforced end 318 of the housing 300 and almost fully sinks into the reinforced end 318. The loop 201 embraces the bolt 302 when both 302 the housing 300 and the bolt 302 are in their extended positions and the bolt 302 is passing through the opening 210 in the loop 201. As a result, the loop 201 prevents any lateral movement of the locking device 400 relative to gate 402 when locking device 400 is in the locked position.

The invention claimed is:

1. An electrically operable locking device (400), for locking a gate (402), said locking device (400) comprising:

a frame (200) for mounting said locking device (400) to said gate (402), and a housing (300) slidably movable with respect to the frame (200) between an upper position and a lower position and comprising a drop bolt (302) arranged to be moved electrically between an extended drop bolt position and an retracted drop bolt position and a mechanical locking mechanism (301) arranged to lock and unlock the housing (300) to the frame (200) and comprising a key-operated cylinder lock (303) to unlock the housing (300) to the frame (200), wherein said gate (402) is locked if said housing (300) is in the lower position and said drop bolt (302) is in the extended position, and wherein said locking device (400) further comprises a resilient element (309) positioned between said frame (200) and said housing (300) and arranged to lift the housing (300) relative to the frame when said housing (300) is unlocked from the frame (200) by operation of said key-operated cylinder lock (303), wherein said housing (300) comprises a reinforced end (318) and said frame (200) comprises a 1oop (201), and wherein said reinforced end (318) s arranged to cover said loop (201) when said housing (300) is in the lower position such that he loop (201) is embedded in said reinforced end (318) of said housing (300).

2. An electrically operable locking device (400), for the locking of a gate (402), the gate controlling the access through a passage, the device (400) provided for locking the gate (402) by electrically extending a drop bolt (302) from a housing (300) and engaging the drop bolt with a fixed bolt reception element (403), and for releasing the gate (402) by electrically retracting the drop bolt (302) into the housing (300) and disengaging the drop bolt from the fixed bolt reception element (403), the locking device (400) comprising:

a. a frame (200) for fixing the locking device (400) to the gate (402), b. the frame (200) supporting the housing (300), which is arranged mechanically movable with respect to the frame (200) between an extended position of the housing (300), whereby, if the drop bolt (302) is extended from the housing (300), the drop bolt (302) is engaging with the fixed bolt reception element (403) and the gate (402) is locked, and a retracted position of the housing (300) whereby, if the drop bolt (302) is extended from the housing (300), the drop bolt (302) is disengaged from the fixed bolt reception element (403) and the gate (402) is released, and whereby the housing (300) is provided with a mechanical locking mechanism (301) provided for locking the housing (300) to the frame (200) in at least the extended position and with the release of the mechanical locking mechanism (301) allowing the mechanical movement of the housing (300) from the extended position of the housing (300) into the retracted position of the housing (300) and whereby the locking device (400) further comprises a resilient element (309) provided for, upon release of the mechanical locking mechanism (301), by the relaxation of the resilient element (309) urging the housing (300) noticeably out of its extended position.

3. The locking device (400) according to claim 1, wherein said frame (200) comprises a notch (206) in the frame and said mechanical locking mechanism (301) comprises a projecting member (332), and wherein said projecting member (332) is arranged to move in and out said notch (206) of said frame (200) to lock and to unlock said housing (300) to the frame (200).

4. The locking device (400) according to claim 3, wherein said mechanical locking mechanism (301) comprises an intermediary locking element (305) rotatably mounted in the housing (300), said intermediary locking element (305) comprising said projecting member (332) and arranged such that rotation of said intermediary locking element (305) moves said projecting member (332) in and out of said notch (206).

5. The locking device (400) according to claim 4, wherein said mechanical locking mechanism (301) comprises a spring (306) arranged to press said projecting member (332) of said intermediary locking element (305) into said notch (206) of the frame (200).

6. The locking device (400) according to claim 5, wherein said projecting member (332) is chamfered such that when the projecting member is contacting an edge of the frame when moved from the upper position towards the lower position, the projecting member (332) is moved into the housing against the action of the spring (306).

7. The locking device (400) according to claim 4, wherein said intermediary locking element (305) is rotatable about an axis in a first direction and wherein said key-operated cylinder lock has an axis of rotation substantially perpendicular to said first direction.

8. The locking device (400) according to claim 4, wherein said key-operated cylinder lock (303) comprises a fixed mounted cylinder housing and an acting member (304) rotatable to said cylinder housing arranged to act on said intermediary locking element (305) when rotated.

9. The locking device (400) according to claim 8, wherein said intermediary locking element (305) comprises at least one pivot part (340, 341), and wherein said at least one pivot part (340, 341) is located closer to a contact area with said acting member (304) than to said notch (204).

10. The locking device (400) according to claim 1 or 2, wherein said housing (300) comprises a horizontally mounted coil spring (310) and a spring support element (325) enclosing said coil spring, said coil spring (310) being arranged to act between said housing (300) and said frame (200) to keep the housing in the upper position.

11. The locking device (400) according to claim 10, said frame (200) comprising an opening (207) and said spring support element (325) comprising a projection (308), wherein said projection (308) is arranged to be pressed into said opening (207) by said coil spring (310) when said housing (300) is in upper position.

12. The locking device (400) according to claim 1 or 2, wherein one of the housing (300) and the frame (200) is provided with at least one protrusion (208) and the other one of the housing (300) and the frame (200) is provided with at least one guide (321) for accepting the protrusion (208), and wherein the cooperation of the protrusion and the guide is arranged to guide relative movement of the housing (300) with respect to the frame (200).

13. The locking device (400) according to claim 1 or 2 wherein said device (400) comprises an electrical power cable (209), and wherein said housing (300) comprises a flexible cable guide (312), said flexible cable guide (312) being arranged to guide said electrical power cable (209).

14. The locking device (400) according to claim 2, wherein said frame (200) comprises a notch (206) in the frame and said mechanical locking mechanism (301) comprises a projecting member (332), and wherein said projecting member (332) is arranged to move in and out said notch (206) of said frame (200) to lock and to unlock said housing (300) to the frame (200).

15. The locking device (400) according claim 14, wherein said mechanical locking mechanism (301) comprises an intermediary locking element (305) rotatably mounted in the housing (300), said intermediary locking element (305) comprising said projecting member (332) and arranged such that rotation of said intermediary locking element (305) moves said projecting member (332) in and out of said notch (206).

16. The locking device (400) according to claim 15, wherein said mechanical locking mechanism (301) comprises a spring (306) arranged to press said projecting member (332) of said intermediary locking element (305) into said notch (206) of the frame (200).

17. The locking device (400) according to claim 16, wherein said projecting member (332) is chamfered such that when the projecting member is contacting an edge of the frame when moved from the upper position towards the lower position, the projecting member (332) is moved into the housing against the action of the spring (306).

18. The locking device (400) according to claim 15, wherein said mechanical locking mechanism (301) comprises a key-operated cylinder lock (303) to unlock the housing (300) to the frame (200), wherein said intermediary locking element (305) is rotatable about an axis in a first direction and wherein said key-operated cylinder lock has an axis of rotation substantially perpendicular to said first direction.

19. The locking device (400) according to claim 15, wherein said mechanical locking mechanism (301) comprises a key-operated cylinder lock (303) to unlock the housing (300) to the frame (200), wherein said key-operated cylinder lock (303) comprises a fixed mounted cylinder housing and an acting member (304) rotatable to said cylinder housing arranged to act on said intermediary locking element (305) when rotated.

20. The locking device (400) according to claim 18, wherein said intermediary locking element (305) comprises at least one pivot part (340, 341), and wherein said at least one pivot part (340, 341) is located closer to a contact area with said acting member (304) than to said notch (204).

* * * * *